United States Patent [19]

Rehman

[11] Patent Number: 4,664,729

[45] Date of Patent: May 12, 1987

[54] WATER-IN-OIL EXPLOSIVE EMULSION COMPOSITION

[75] Inventor: Habib U. Rehman, Pottsville, Pa.

[73] Assignee: Independent Explosives Co. of Penna., Scranton, Pa.

[21] Appl. No.: 851,488

[22] Filed: Apr. 14, 1986

[51] Int. Cl.[4] ..... C06B 45/02

[52] U.S. Cl. ..... 149/21; 149/2; 149/47; 149/62; 149/88; 149/92; 149/93; 149/111

[58] Field of Search ..... 149/2, 21, 47, 62, 88, 149/92, 93, 111

[56] References Cited

U.S. PATENT DOCUMENTS

| | | | |
|---|---|---|---|
| 4,326,900 | 4/1982 | Hattori et al. | 149/2 |
| 4,371,408 | 2/1983 | Fillman | 149/2 |
| 4,383,873 | 5/1983 | Wade et al. | 149/2 |
| 4,453,989 | 6/1984 | Mullay | 149/2 |
| 4,595,430 | 6/1986 | Baker | 149/88 |

*Primary Examiner*—Stephen J. Lechert, Jr.

*Attorney, Agent, or Firm*—Burns, Doane, Swecker & Mathis

[57] ABSTRACT

Provided is a water-in-oil explosive emulsion composition having a ½ cartridge gap sensitivity of at least about three inches, yet a water content of at least about 10 percent by weight. The composition comprises an emulsion matrix of a hydrocarbon or carbonaceous fuel component, at least one inorganic oxidizer, an emulsifier and water in an amount of at least about ten percent by weight of the emulsion matrix. In addition to the emulsion matrix, the composition further comprises from 1 to 12 weight percent of a water insoluble sensitizer and sufficient density control agent such that the density of the composition is at least 1.0 g/cc. The resulting composition exhibits excellent sensitivity in combination with excellent stability. Another advantage of the resulting composition is that it exhibits an improved ability to withstand underwater wave compression (dead pressness) which often results in total failure of any explosive in the near vicinity.

21 Claims, No Drawings

WATER-IN-OIL EXPLOSIVE EMULSION COMPOSITION

BACKGROUND OF THE INVENTION

Field of the Invention

This invention relates to water-in-oil explosive compositions and, more specifically, to cap sensitive emulsion explosives. In another aspect, this invention relates to emulsion explosive compositions which are capable of achieving favorable incendivity and ½ cartridge gap sensitivity properties, while exhibiting excellent stability.

Description of the Prior Art

Water-in-oil emulsion type blasting agents were first disclosed by Bluhm in U.S. Pat. No. 3,447,978. These emulsion type blasting agents were very coarse, of low sensitivity and reduced shelf life. The agents contained an aqueous solution of inorganic oxidizer salts that was emulsified as the dispersed phase within a continuous carbonaceous fuel phase, and a uniformly distributed gaseous component. Later, cap sensitive emulsion explosive compositions were produced using explosive additives such as trinitrotoluene (TNT), and pentaerythritol tetranitrate (PETN). See, e.g., U.S. Pat. No. 3,770,522. Water-in-oil emulsion explosive compositions have also been made cap sensitive by the addition of nonexplosive detonation catalysts. In this regard, see, e.g., U.S. Pat. Nos. 3,715,247 and 3,765,964. Most recently, cap sensitive water-in-oil emulsion type explosive compositions, containing neither explosive ingredients nor detonation catalysts, have been disclosed in U.S. Pat. Nos. 4,110,134, 4,149,916 and 4,149,917.

Other water-in-oil emulsion type blasting agents are disclosed in U.S. Pat. Nos. 3,674,578, 4,470,855 and 4,216,040. The first, U.S. Pat. No. 3,674,578, issued to Cattermole et al, discloses an emulsion type blasting agent containing an inorganic oxidizing salt, a nitrogen-base salt, water, water-insoluble organic fuel that forms a continuous oil phase, a lipophilic emulsifier and gas bubbles. It is alleged that the combination of nitrogen-base salt and gas bubbles in the water-in-oil emulsion results in a blasting agent that is safe yet sensitive to detonation. U.S. Pat. No. 4,470,855, issued to Bampfield, discloses a water-in-wax emulsion explosive composition wherein the continuous carbonaceous fuel phase comprises paraffin wax together with a minor amount of a rheology modifier and stabilizer combination comprising an ethylene-containing polymer and a low molecular weight hydrocarbon liquid. U.S. Pat. No. 4,216,040, issued to Sudweeks et al, discloses an emulsion blasting composition having a discontinuous aqueous phase, a continuous oil or water-immiscible liquid organic phase, and an emulsifier having an unsaturated hydrocarbon chain for its lipophilic portion.

While the cap sensitive emulsion explosive compositions disclosed in the above-identified patents satisfy a wide range of requirements, there are certain blasting applications in which even higher sensitivities than are available using such compositions would be advantageous. For example, in coal mining where it is especially important that a string of cartridges be able to propagate the explosion from one cartridge to the next. One-half cartridge gap sensitivity tests are used to determine the suitability of the explosive for use in such applications. Basically, this test measures sensitivity in terms of the length of the air gap across which one half of a standard cartridge (1¼" by 8" in length) of explosive material can detonate a second half of a cartridge. Thus, for example, the preferred cap sensitive emulsion explosive compositions as prepared according to the disclosures of U.S. Pat. No. 4,110,134, have an air gap sensitivity of about two inches. As noted above, however, cap sensitive compositions having sensitivities greater than those generally available in cap sensitive emulsion explosive compositions are desirable in certain blasting applications, e.g., a gap sensitivity of at least about three inches.

Various formulations have been attempted in order to achieve improved sensitivity. For example, U.S. Pat. No. 4,547,232 discloses a high density emulsion blasting agent of improved sensitivity by utilizing an effective amount of a special sensitizing formulation in total or partial substitution for gas entraining density control agents. The sensitizing formulation was comprised of a polynitrate ester of a 2–5 carbon polyhydric alcohol, nitrocellulose and ammonium nitrate. Note also U.S. Pat. No. 4,383,873, issued to Wade and Fillman, which discloses cap sensitive emulsion explosive compositions comprising a discontinuous aqueous oxidizer salt phase, a continuous carbonaceous fuel phase, and closed cell void containing materials, which compositions exhibit increased sensitivity due to a reduced water content in the range of from about 4% to less than about 10% by weight of the emulsion matrix used to prepare the composition. U.S. Pat. No. 4,371,408, issued to Fillman, also discloses a sensitive, low water containing water-in-oil emulsion explosive composition wherein increased gap sensitivity is achieved by employing an emulsion matrix of reduced water content, i.e., less than about 10%, in combination with an amine sensitizing agent and a relatively minor portion of a detonation catalyst, such as copper chloride.

Though the foregoing compositions have achieved some success in the formulation of a sensitive blasting agent, there is, however, only one permissible emulsion high explosive in the U.S. market today. While other cap sensitive emulsion explosives may be made, problems in their method of preparation and achieving an air gap sensitivity of at least 3 inches, which is an important requirement of the Bureau of Mines, have prevented such emulsion explosives from achieving certification by the Bureau of Mines.

The sensitizer used in the foregoing permissible emulsion explosive is ethylene diamine dinitrate (EDDN) in an amount of 4 percent to about 6 percent. In its preparation, the EDDN is dissolved in the oxidizer solution of one or more inorganic salts at 210° F. to 220° F. The sensitizer solution is then subjected to tremendous mechanical agitation with fuel. The mechanical agitation breaks the solution into tiny droplets of from 2 to 6 microns which become covered with fuel, thereby forming an emulsion. The EDDN sensitized oxidizer solution, however, is not regarded as safe.

Thus, problems in the safety, simplicity and economy of the composition, as well as the stability of the agents also arise and are important considerations. This is particularly true for the low water emulsion compositions, e.g., from 4 to 10% by weight water of the emulsion matrix, as they exhibit a tendency to become dry upon aging. The compositions become dry, crumbly and hard upon aging, thus making the product less sensitive. It would therefore be of great value to the industry if an economical, stable and sensitive explosive composition were available, i.e., a composition having a gap sensitivity of at least about three inches, without a sacrifice in the stability of the composition.

As well, most water-in-oil emulsion explosives exhibit a poor ability to withstand an underwater shock wave, often resulting in total failure of an explosive in the near vicinity of a first detonated cartridge. The common type of water-in-oil emulsion explosive with no extra chemical sensitizer sometimes fails to shoot even at a distance of 2½ feet from the first cartridge. An emulsion explosive exhibiting an improved ability to withstand underwater wave compression (dead pressness) would be of great value to the industry.

Accordingly, it is an object of the present invention to provide a novel water-in-oil explosive emulsion composition which has a gap sensitivity of at least about three inches.

Another object of the present invention is to provide such a composition which is also economical and exhibits good stability.

Still another object of the present invention is to provide such a novel water-in-oil explosive emulsion composition which comprises at least 10% by weight water, and has a density of at least about 1.0 g/cc.

Another object of the present invention is to provide a novel water-in-oil explosive emulsion composition which exhibits an improved underwater shock compression distance.

These and other objects, as well as the scope, nature and utilization of the invention, will be apparent to those skilled in the art from the following description and the appended claims.

SUMMARY OF THE INVENTION

In accordance with the foregoing objectives, there is provided by the subject invention a water-in-oil explosive emulsion composition having a one-half cartridge gap sensitivity of at least about three inches, and which also exhibits good stability. The composition comprises an emulsion matrix, which matrix comprises a hydrocarbon or carbonaceous fuel component, at least one inorganic oxidizer, an emulsifier and water in an amount of at least ten percent by weight of the emulsion matrix. In addition to the emulsion matrix, the water-in-oil emulsion composition further comprises from 1 to about 12 weight percent of a water insoluble sensitizer and sufficient density control agent, e.g., glass microspheres such that the density of the composition is at least 1.0 g/cc, and an improved ability to withstand underwater wave compression (dead pressness).

DETAILED DESCRIPTION OF THE PREFERRED EMBODIMENTS

Provided by the present invention, therefore, is an improved form of a water-in-oil emulsion explosive which is surprisingly sensitive, i.e., having a gap sensitivity of at least about three inches, yet stable. The stability is partly achieved by keeping the water content fairly high, i.e., above 10 weight percent. The composition also offers the advantages of economy due to the relatively small amounts of sensitizer employed, i.e., less than about 12 weight percent. The sensitizer employed is generally a water insoluble sensitizer. The explosive composition also offers the advantages of a highly sensitive yet high density composition, i.e., above 1.0 g/cc, and a composition exhibiting an improved ability to withstand underwater wave compression (dead pressness).

As used herein, the term "matrix" and/or "emulsion matrix" is defined as the water-in-oil emulsion including fuel, emulsifiers, water and inorganic oxidizing salts but excluding closed cell void-containing materials and sensitizer. The emulsion explosive composition of the present invention is generally prepared by admixing the closed cell void-containing materials and the sensitizing agent with the matrix.

The water-in-oil explosive emulsion composition of the present invention comprises, as a continuous phase thereof, from about 2.0% to about 10.0%, and preferably from about 4.5% to about 6.5% by weight of a carbonaceous fuel component, including an emulsifier. The carbonaceous fuel component can include most hydrocarbons, for example, paraffinic, olefinic, naphthenic, aromatic, saturated or unsaturated hydrocarbons. In general, the carbonaceous fuel is a water immiscible emulsifiable fuel that is either liquid or liquefiable at a temperature up to about 200° F., and preferably between about 110° and about 160° F. In general, it is preferred that at least about 2.0% by weight of the total explosive composition should be either a wax or oil, or a mixture thereof. If a mixture of wax and oil is employed, the wax content can preferably range from about 1.0% to about 3.0% by weight and the oil content can range from about 3.0% to about 1.0% by weight (depending on wax content) of the total emulsion.

Suitable waxes having melting points of at least about 80° F. such as petrolatum wax, microcrystalline wax, and paraffin wax, mineral waxes such as ozocerite and montan wax, animal waxes such as spermacetic wax, and insect waxes such as beeswax and Chinese wax can be used in accordance with the present invention. Examples of preferred waxes include waxes identified by the trade designations INDRA such as INDRA 5055-G, INDRA 4350-E, and INDRA 2119 sold by Industrial Raw Materials Corporation. Also suitable is ARISTO 143 sold by Union 76. Other suitable waxes are WHITCO 110X, WHITCO ML-445, and X145-A, which are marketed by Whitco Chemical Company Inc. The most preferred waxes are a blend of microcrystalline waxes and paraffin, such as the wax sold under the trade designation INDRA 2119, identified above. In this regard, more sensitive emulsions can be obtained by using a blend of microcrystalline wax and paraffin rather than microcrystalline or paraffin wax alone.

Suitable oils useful in the compositions of the present invention include the various petroleum oils, vegetable oils, and mineral oils, e.g., a highly refined white mineral oil sold by Whitco Chemical Company, Inc. under the trade designation KAYDOL and the like.

The carbonaceous fuel component of the subject invention will also include the emulsifier used to form the emulsion explosive composition. Any of a wide variety of water-in-oil emulsifiers can be employed. The following examples are provided purely as an illustration of suitable emulsifiers and are not meant to be limitative. Thus, suitable emulsifiers which can be employed in the emulsion explosives of the present invention include those derivable from sorbitol by esterification with removal of one molecule of water such as sorbitan fatty acid esters, for example, sorbitan monolaurate, sorbitan monooleate, sorbitan monopalmitate, sorbitan monostearate, and sorbitan tristearate. Other useful materials comprise mono- and diglycerides of fat-forming fatty acids, as well as polyoxyethylene sorbitol esters, such as polyethylene sorbitol beeswax derivative materials and polyoxyethylene(4)lauryl ether, polyoxyethylene(2)ether, polyoxyethylene(2)stearyl ether, polyoxyalkylene oleate, polyoxyalkylene laurate, oleyl acid phosphate, substituted oxazolines and phosphate esters, mixtures thereof and the like. In general, the emulsifiers should be present in an amount ranging from about 0.5% to about 3.0% by weight of the total composition, and preferably from about 0.8% to about 2.0% by weight of the total composition.

The aqueous phase of the explosive emulsion compositions of the present invention contains greater than 10 percent by weight of the emulsion matrix of water. Thus, the emulsion matrices of the compositions of the present invention contain greater than 10 percent, and preferably from 10 to about 20 weight percent, and most preferably from 11 to about 15 weight percent water. Such a large amount of water is unusual in an emulsion explosive composition having the gap sensitivity of the present invention. Yet, it has been found that the specific compositions of the present invention exhibit high sensitivity. The relatively high amount of water permits for advantages in the stability of the composition, as the composition is less likely to dry out and lose its sensitivity. The relatively high water content in the water-in-oil emulsion composition of the present invention also contributes towards stability of the composition in that it allows an equilibrium with the outer moisture to be maintained and thus loss or gain is restricted; it permits attaining the smallest droplet size during the emulsification process due to a lower viscosity of the oxidizer solution; and, it lowers the crystallization point of the very strong oxidizer solution to a safe working temperature. Thus, the compositions of the present invention not only provide one with an initial highly sensitive explosive composition, but with a composition which will also maintain its high sensitivity for a relatively long period of time.

The stability of the explosive composition is also enhanced by keeping the particle of the emulsion matrix to as small a size as possible. A completely transparent emulsion matrix (when hot) corresponds to a size of 0.5 microns or less. In a preferred embodiment of the present invention, the emulsion matrix of the present inventive composition is made completely transparent to such an extent that a thermometer dropped into it can be read easily through the layers.

The inorganic oxidizing salts employed in the present compositions are generally dissolved in the water, and will generally comprise from about 65% to about 85% by weight of the emulsion explosive composition. A major proportion of the inorganic oxidizing salt content is preferably comprised of ammonium nitrate. However, mixtures of ammonium nitrate and other alkali and alkaline earth metal nitrates as well as alkali and alkaline earth metal perchlorates can be successfully employed as the inorganic oxidizing salt components of the emulsions of the present invention. The use of perchlorates, however, is somewhat discouraged as they become very impact and friction sensitive when dry. Thus, preferred inorganic oxidizing salts, in addition to ammonium nitrate, include sodium nitrate. However, other nitrates such as calcium nitrate can also be used.

The sensitizer employed in the emulsion explosive composition of the present invention is importantly a water insoluble sensitizer. Water soluble sensitizers such as EDDN provide a hazard in the formulation of the emulsion. Examples of suitable water insoluble sensitizers include, but are not limited to, pentaerythritol tetranitrate (PETN), RDX, nitroglycerine, ethylene glycol dinitrate and trimethylolethane trinitrate, with PETN being most preferred.

When using PETN and RDX, either coarse or fine particle size PETN or RDX can be used. It is preferred, however, to use fine PETN or RDX as it has been discovered that increased sensitivity is attained when using a fine grade PETN or RDX. A fine grade or particle size PETN or RDX may be defined as when at least 90 percent of the particles pass through a 40 mesh screen.

The amount of sensitizer employed is generally in the range of greater than 1 weight percent of the total composition, up to about 12 weight percent. More preferably, the amount of sensitizer is in the range of from about 2.0 weight percent to about 10.0 weight percent, and most preferably from about 2.5 weight percent to about 10.0 weight percent. Such limited amounts of sensitizer permit an economical formulation, yet still provides excellent sensitivity.

In addition, the emulsion explosive compositions of the present invention employ closed cell void containing materials as a density control agent. Such materials can include any particulate material which comprises closed cell, hollow cavities. Each particle of the material can contain one or more closed cells, and the cells can contain a gas, such as air, or can be evacuated or partially evacuated. Sufficient closed cell void containing materials should be utilized to yield a density of the resulting emulsion composition of at least 1 gram/cc, and more preferably from 1.1 to 1.3 grams/cc. Generally, from about 0.25% to about 10% by weight of the explosive emulsion composition of such materials can be employed for this purpose, with from 2.0% to about 5% by weight being preferred.

The preferred closed cell void containing materials used in the compositions of the subject invention are discrete glass spheres having a particle size in the range from about 10 to about 175 microns, and most preferably having a diameter of about 60 to 70 microns. In general, the particle density of such bubbles can be within the range of about 0.1 to about 0.7 grams/cc. Some preferred types of glass microbubbles which can be utilized within the scope of the subject invention are the microbubbles sold by 3M Company and which have a particle size distribution in the range of from about 10 to about 160 microns and a nominal size in the range of from about 60 to 70 microns, and densities in the range of from about 0.1 to about 0.4 grams/cc. Preferred microbubbles sold by 3M Company are distributed under the trade designations B15-250 and C-15-250. Further examples of such materials include those sold under the trade designation Eccospheres by Emerson & Cumming, Inc. and which generally have a particle size range of from about 44 to about 175 microns at a particle density of about 0.15 to about 0.4 grams/cc. Microbubbles sold under the designation Q-Cell 200 by Philadelphia Quartz Company are also suitable. When glass microbubbles are employed in the compositions of the subject invention, they can comprise from about 1.0% to about 5% by weight thereof.

The closed cell void containing material can also be made of inert or reducing materials. For example, phenolformaldehyde microballoons can be utilized. Such microballoons are themselves a fuel component for the explosive, and as such, their fuel value should be taken into consideration when designing a water-in-oil emulsion explosive composition.

In addition to the above components of the explosive emulsions of the present invention, auxiliary fuels can also be employed. An excellent auxiliary fuel, which is nonexplosive, is particulate aluminum. Aluminum, and other nonexplosive auxiliary fuels, can be employed in amounts ranging from 0 to about 20% by weight of the emulsion explosive composition.

The explosive emulsions of the subject invention can be prepared by premixing the water and inorganic oxidizer salts and soluble detonation catalysts in a first premix, and the carbonaceous fuel and emulsifier in a second premix. The two premixes are heated, if necessary. The first premix is generally heated until the salts are completely dissolved (about 120° to about 220° F.) and the second premix is heated, if necessary, until the carbonaceous fuel is liquefied (generally about 120° F. or more if wax materials are utilized). The premixes are then blended together and emulsified, to form the emulsion matrix and thereafter the sensitizer is added to the emulsion with the glass microbubbles, or other gas entrapping materials, being added until the density is lowered to the desired range. For added sensitivity, a fine grade of sensitizer, preferably phelegmatized PETN, can be added in a small amount, e.g., from 1.0 to about 10.0 weight percent, into the emulsion matrix during the blending of the premixes.

In the continuous manufacture of emulsion explosive compositions, it is preferred to prepare an aqueous solution containing the oxidizers in one tank and to prepare a mix of the organic fuel components (excluding the emulsifier) in another tank. The two liquid mixes and the emulsifier are then pumped separately into a mixing device wherein they are emulsified. The emulsion matrix is next pumped to a blender where the glass microbubbles and sensitizer are added and uniformly blended to complete the water-in-oil emulsion. The resulting emulsion is then procesed through a Bursa filler or other conventional device into packages of desired diameters. For example, the emulsion explosives can be packaged in spiral wound or convoluted polymer laminated paper cartridges.

The incendivity of emulsion compositions of the present invention are controllable by adjusting the ratio of water and sodium nitrate. Thus, no inert salt is necessary for this purpose. However, if desired or deemed necessary, additions of inert salts such as calcium chloride, potassium chloride or sodium chloride to the emulsion explosive compositions of the present invention can be made. Such addition is generally only considered when a sensitizer other than PETN or RDX is used.

The following Examples are given as a specific illustration of the claimed invention. It should be understood, however, that the specific details set forth in the Examples are merely illustrative and in nowise limitative. All parts and percentages in the Examples and the remainder of the specification are by weight unless otherwise specified.

EXAMPLE 1

Various explosive compositions were prepared by mixing the inorganic oxidizers with water to prepare a premix. A second mix of carbonaceous fuel and the emulsifier was then prepared. The first premix was then slowly added to the second premix with agitation to form a water-in-oil emulsion matrix. Thereafter, the sensitizer and glass micro-spheres were blended into the emulsion to form the final composition.

The general compositions employed were as follows:

| | | | | |
|---|---|---|---|---|
| Solid or Liquid Sensitizer | 1.10 | 2.5 | 5.0 | 10.0 |
| Oxidizer (1) | 79.5 | 78.0 | 75.5 | 70.5 |
| Water | 11.0 | 11.0 | 11.0 | 11.0 |
| Fuel (2) | 4.2 | 4.2 | 4.2 | 4.2 |
| Emulsifier (3) | 1.3 | 1.3 | 1.3 | 1.3 |
| Glass Micro-Spheres (4) | 3.0 | 3.0 | 3.0 | 3.0 |
| TOTAL | 100.0 | 100.0 | 100.0 | 100.0 |

(1) 14% Na $NO_3$, 86% $NH_4NO_3$
(2) ⅓ paraffin wax, ⅓micro-crystalline wax, ⅓mineral oil
(3) Sorbitan mono oleate
(4) 3M C-15-250

All of the compositions were extruded or tamped into paper tubes having a 1¼ inch diameter and sealed. The air gap sensitivity of the compositions were then tested. The sensitizer, the amount of sensitizer used and the results of the air gap test are recorded below for each run.

| | | Cap | Air Gap | |
|---|---|---|---|---|
| Sensitizer/Amt. | Density | Sensitivity | Shot | Failed |
| None | 1.18 | #8 | 1" | 2" |
| Fine PETN | | | | |
| 1% | 1.17 | #4 | 1" | 2" |
| 2.5% | 1.18 | #3 | 4" | 4½" |
| 2.5% | 1.10 | #3 | 4" | 4½" |
| 5.0% | 1.18 | #3 | 4½" | 5" |
| 10.0% | 1.18 | #3 | 4½" | 5" |
| Coarse PETN | | | | |
| 1% | 1.18 | #5 | 1" | 2" |
| 2.5% | 1.18 | #3 | 3" | 3½" |
| 5.0% | 1.17 | #3 | 3" | 3½" |
| 10.0% | 1.17 | #3 | 3½" | 4" |
| RDX (Fine) | | | | |
| 2.5% | 1.17 | #6 | 3½" | 4" |
| Nitro-Glycerine | | | | |
| 1% | 1.18 | #3 | 3" | 4" |
| 2.5% | 1.18 | #3 | 6" | 7½" |
| Ethylene Glycol Dinitrate | | | | |
| 1% | 1.18 | #3 | 3" | 3½" |
| 2.5% | 1.17 | #3 | 4½" | 6" |
| Trimethylolethane Trinitrate | | | | |
| 1% | 1.17 | #5 | 3" | 3½" |
| 2.5% | 1.18 | #4 | 3½" | 4" |

The fine and coarse PETN may be characterized as follows:

| Screen Analysis of Course and Fine PETN | | |
|---|---|---|
| Mesh | Coarse PETN | Fine PETN |
| 20 | TR | Nil |
| 30 | 6.0 | 1.8 |
| 40 | 22.0 | 6.2 |
| 60 | 30.0 | 36.0 |
| 80 | 30.0 | 26.0 |
| 100 | 6.0 | 8.0 |
| PAN | 6.0 | 22.0 |

The foregoing runs show that when greater than 1% of the sensitizer is used in the emulsion composition of the present invention, an air gap sensitivity of at least three inches is generally realized. This is true even though the amount of sensitizer is relatively small, i.e., 10% or less, and the amount of water in the composition is relatively high, at least 10%.

EXAMPLE 2

Various other explosive compositions were prepared by mixing the inorganic oxidizers with water to prepare a premix. A second mix of carbonaceous fuel and the emulsifier was then prepared. The first premix was then slowly added to the second premix with agitation to form a water-in-oil emulsion matrix. Thererafter, the sensitizer and glass micro-spheres were blended into the emulsion to form the final composition.

All of the compositions were extruded or tamped into paper tubes having a 1¼ inch diameter and sealed. Composition No. 2 with EDDN as the sensitizer is in accordance with the disclosure of U.S. Pat. No. 4,383,873. The air gap sensitivity and underwater shock compression escape distance of the compositions were then tested. The test for underwater shock compression distance involved using two vertical sticks of explosive under about two feet of water. The two sticks were detonated 250 milliseconds apart. The compression distance is that distance where the 2nd cartridge escapes the dead pressness due to the shock wave produced by the first stick of explosive and is hence able to shoot. The composition and the results of the tests are recorded below:

TABLE

| INGREDIENTS | Composition No. 1 | No. 2 | No. 3 | No. 4 |
|---|---|---|---|---|
| Water | 10.0 | 10.0 | 10.0 | 10.0 |
| Wax (1) | 3.0 | 3.0 | 3.0 | 3.0 |
| Oil (2) | 1.0 | 1.0 | 1.0 | 1.0 |
| Emulsifier (3) | 1.0 | 1.0 | 1.0 | 1.0 |
| Ammonium nitrate | 70.5 | 68.0 | 68.0 | 68.0 |
| Sodium nitrate | 12.0 | 12.0 | 12.0 | 12.0 |
| EDDN | — | 2.5 | — | — |
| RDX (fine grade) | — | — | 2.5 | — |
| PETN (fine grade) | — | — | — | 2.5 |
| Glass microspheres (4) | 2.5 | 2.5 | 2.5 | 2.5 |
| TOTAL | 100.00 | 100.00 | 100.00 | 100.00 |
| Density (gram/cc) | 1.17 | 1.17 | 1.17 | 1.17 |
| ½ cartridge gap sensitivity (inches) | 1½ | 3 | 3½ | 4½ |
| Shock compression escape distance (inches) | 28 | 28 | 16 | 16 |

(1) ½ paraffin wax and ½ micro-crystalline wax
(2) mineral oil
(3) Sorbitan mono oleate
(4) 3M C-15-250

The foregoing runs demonstrate that the shock compression escape distance for Composition No. 2 with 2.5% EDDN is the same as for Composition No. 1 having no sensitizer at all. To the contrary, a significant improvement in the shock compression escape distance is observed for Composition Nos. 3 and 4.

Although the invention has been described with preferred embodiments, it is to be understood that variations and modifications may be resorted to as will be apparent to those skilled in the art. Such variations and modifications are to be considered within the purview and the scope of the claims appended hereto.

What is claimed is:

1. A water-in-oil explosive emulsion composition having ½ cartridge gap sensitivity of at least about three inches, consisting essentially of (i) an emulsion matrix comprising a hydrocarbon or carbonaceous fuel component, at least one inorganic oxidizer, an emulsifier and water, with the amount of water being at least ten percent by weight of the emulsion matrix;

(ii) a solid, water insoluble sensitizer in an amount ranging from greater than 1 up to about 12 weight percent of the total composition; and, (iii) sufficient closed cell, void containing density control agent such that the density of the composition is at least 1.0 g/cc.

2. The water-in-oil explosive emulsion composition of claim 1, wherein from about 65% to about 85% by weight of the total composition is inorganic oxidizing salts, from 2.0 to about 10.0% by weight of the total composition is carbonaceous fuels including an emulsifier, and from about 0.25% to about 10% by weight of the total composition is closed cell void containing materials as the density control agent.

3. The water-in-oil explosive emulsion composition of claim 2, wherein from about 4.5% to about 6.5% by weight of the total composition is carbonaceous fuels including an emulsifier.

4. The water-in-oil explosive emulsion composition of claim 2, wherein from about 2% to about 5% by weight of the total composition is closed cell void containing materials.

5. The water-in-oil explosive composition of claim 2, wherein from about 2% to about 10% by weight of the total composition is the water insoluble sensitizer.

6. The water-in-oil explosive composition of claim 5, wherein the amount of water insoluble sensitizer ranges from about 2.5% to about 10% by weight of the total composition.

7. The water-in-oil explosive composition of claim 1, wherein the water insoluble sensitizer is pentaerythritol tetranitrate.

8. The water-in-oil explosive composition of claim 1, wherein the water insoluble sensitizer is cyclotrimethylene trinitramine.

9. The water-in-oil explosive composition of claim 7, wherein the pentaerythritol tetranitrate is a fine grade pentaerythritol tetranitrate.

10. The water-in-oil explosive composition of claim 8, wherein the cyclotrimethylene trinitramine is a fine grade cyclotrimethylene trinitramine.

11. The water-in-oil explosive composition of claim 6, wherein the water insoluble sensitizer is pentaerythritol tetranitrate.

12. The water-in-oil explosive composition of claim 11, wherein the pentaerythritol tetranitrate is a fine grade pentaerythritol tetranitrate.

13. The water-in-oil explosive composition of claim 1, wherein the water insoluble sensitizer is nitro-glycerine, ethylene glycol dinitrate or trimethylolethane trinitrate.

14. A water-in-oil explosive emulsion composition having a ½ cartridge gap sensitivity of at least about three inches, consisting essentially of (i) an emulsion matrix comprising a carbonaceous fuel component comprised of a mixture of wax and mineral oil, at least one inorganic oxidizer, an emulsifier and water, with the amount of water being at least ten percent by weight of the emulsion matrix;

(ii) pentaerythritol tetranitrate in an amount ranging from greater than 1 up to about 12 weight percent of the total composition; and, (iii) sufficient density control agent such that the density of the composition is at least 1.0 g/cc.

15. The water-in-oil explosive emulsion composition of claim 14, wherein from about 65% to about 85% by weight of the total composition is inorganic oxidizing salts, from 2% to about 10% by weight of the total composition is the carbonaceous fuel component including emulsifier, and from about 0.25% to about 10% by weight of the total composition is closed cell void containing materials as the density control agent.

16. The water-in-oil explosive emulsion composition of claim 14, wherein the inorganic oxidizer is a mixture of sodium nitrate and ammonium nitrate, and the carbonaceous fuel component is a mixture of paraffin wax, micro-crystalline wax and mineral oil.

17. The water-in-oil explosive emulsion composition of claim 16, wherein the inorganic oxidizer comprises about 14% sodium nitrate and 86% ammonium nitrate.

18. The water-in-oil explosive emulsion composition of claim 16, wherein the carbonaceous fuel component comprises $\frac{1}{3}$ paraffin wax, $\frac{1}{3}$ micro-crystalline wax and $\frac{1}{3}$ mineral oil.

19. The water-in-oil explosive emulsion composition of claim 16, wherein the emulsifier is sorbitan monooleate.

20. The water-in-oil explosive emulsion composition of claim 16, wherein the composition comprises 2.5 weight percent pentaerythritol tetranitrate.

21. A water-in-oil explosive emulsion composition having a $\frac{1}{2}$ cartridge gap sensitivity of at least about three inches, consisting essentially of (i) an emulsion matrix comprising about 4.2% by weight of the total composition of a carbonaceous fuel component which is a mixture of paraffin wax, micro-crystalline wax and mineral oil; about 78% by weight of the total composition of an inorganic oxidizer which is a mixture of sodium nitrate and ammonium nitrate; about 1.3% by weight of the total composition of an emulsifier which is sorbitan monooleate; and about 11% by weight of the total composition of water;

(ii) about 2.5% by weight of the total composition of pentaerythritol tetranitrate; and, (iii) about 3.0% by weight of the total composition of glass micro-spheres as a density control agent.

* * * * *